United States Patent [19]

Juris et al.

[11] 4,349,241

[45] Sep. 14, 1982

[54] ELECTRICAL CONNECTOR ASSEMBLY HAVING ENHANCED EMI SHIELDING

[75] Inventors: Mitchell A. Juris; Vladimir Tomsa, both of Chicago, Ill.

[73] Assignee: Bunker Ramo Corporation, Oak Brook, Ill.

[21] Appl. No.: 148,422

[22] Filed: May 9, 1980

[51] Int. Cl.[3] ..... H01R 13/658

[52] U.S. Cl. ..... 339/143 R

[58] Field of Search ..... 339/143 R, 89 R, 89 C, 339/89 M, 88 R, 90 R

[56] References Cited

U.S. PATENT DOCUMENTS

| | | | |
|---|---|---|---|
| 3,336,569 | 8/1967 | Nava | 339/89 M X |
| 3,512,119 | 5/1970 | Cameron | 339/90 R |
| 3,750,087 | 7/1973 | Vetter | 339/90 R |
| 3,801,954 | 4/1974 | Dorrell | 339/90 R |
| 4,023,881 | 5/1977 | Migneau | 339/89 R |
| 4,176,897 | 12/1979 | Cameron | 339/143 R X |

*Primary Examiner*—Eugene F. Desmond

*Attorney, Agent, or Firm*—Dale A. Kubly; Nicholas A. Camasto

[57] ABSTRACT

An electrical connector assembly having plug and receptacle members and a bayonet-type coupling mechanism is constructed to provide improved shielding from electromagnetic interference (EMI). The shells of the plug and receptacle members abut in metal-to-metal, continuous peripheral contact and the uniquely configured interfacial seal of the assembly is designed to assure the achievement of the metal-to-metal engagement. A peripheral face seal is also provided again to assure metal-to-metal abutment and enhance EMI shielding.

14 Claims, 4 Drawing Figures

10
12
14
16
18
20
22
24
26
28
30
32
42
44
46
50
51
52
54
56
60
62
64
70
72
74
80
96
98
104
106
108
112
114
116
118
4
4

ELECTRICAL CONNECTOR ASSEMBLY HAVING ENHANCED EMI SHIELDING

BACKGROUND OF THE INVENTION

The present invention relates generally to electrical connectors and, particularly, to electrical connectors having superior electromagnetic interference (EMI) shielding characteristics.

In recent years a need has developed, particularly in the aerospace industry and in military applications, for electrical connectors providing effective shielding against EMI and, in certain military applications, having the ability to withstand severe EMI conditions sometimes referred to as electromagnetic pulses (EMP). Many connectors, especially those employing conventional bayonet-type coupling devices, have proven to be inadequate to meet these needs. For example, the conventional bayonet-type coupling mechanisms used in a variety of aerospace and military equipment are designed for easy, effective and positive coupling. They do not, however, provide adequate EMI shielding characteristics for many aerospace and military applications because of the limited coupling forces available and the discontinuities which are found at the interface of the plug and receptacle shells used in state of the art bayonet-type connectors.

Redesign or modification of existing connectors, however, has been complicated by the requirement that these connectors meet other already rigorous specifications relating to electrical performance, environmental resistance, size, coupling and uncoupling performance, and so forth. Thus, a need has developed for a bayonet-type connector having a construction of shell and interface components which will provide a continuity of shielding, and therefore, enhanced EMI shielding, given the limited coupling forces available with bayonet-type coupling mechanisms.

SUMMARY OF THE INVENTION

Accordingly, one object of the present invention is to provide an electrical connector designed to meet the more rigorous EMI shielding criteria now imposed by the military and aerospace industry, while continuing to satisfy presently established electrical and mechanical performance specifications.

Another object of the present invention is the provision of an electrical connector having a coupling mechanism for resiliently mating a pair of complementary connector members and which utilizes metal-to-metal abutment of the respective connector shells to improve EMI shielding characteristics.

A further object of the present invention is the provision of an electrical connector having a coupling mechanism for resiliently mating a pair of complementary connector members and which utilizes an internal, electrically conductive seal to improve EMI shielding characteristics.

Still another object of the invention is the provision of an electrical connector having a bayonet-type coupling mechanism which utilizes metal-to-metal abutment between the respective shells of a pair of complementary connector members to improve the EMI shielding characteristics of the connector, which utilizes an internal, electrically conductive seal to further enhance the EMI shielding characteristics of the connector, and which employs a specially configured interfacial seal to facilitate the attainment of improved EMI shielding characteristics.

In furtherance of these and other objects, the electrical connector of the present invention comprises an assembly having a separable pair of connector members, including respective electrically conductive shells, and means for coupling the connector members in mating engagement, the coupling means including means for resiliently urging the connector shells together. In accordance with one aspect of the present invention, means are included for providing a continuous electrically conductive seal between the connector shells to shield against electromagnetic interference. More particularly, the means for providing a continuous electrical seal between the connector shells comprises a circumferential or annular sealing edge on one of the connector shells. Responsive to the resilient urging of the coupling means, the sealing edge engages the other connector shell to provide continuous circumferential abutment and electrical contact between the connector shells and thereby provide improved shielding against electromagnetic interference. In an embodiment of the present invention hereinafter shown and described, the sealing edge, comprising, for example, the sharp edge of a ridge provided on an annular shoulder or flange of one connector shell, faces forwardly to engage the mating end of the other connector shell.

In accordance with another aspect of the present invention, the continuous electric seal means comprises, alone or in combination with the aforesaid continuous abutment between the connector shells, an electrically conductive elastomeric seal member housed in an opening in the other connector shell. More particularly, the elastomeric seal member is in electrical contact with the connector shell in which it resides, and responsive to mating of the first connector member into the opening, the seal member engages the first connector shell peripherally rearward of the mating end thereof to make a continuous electrical contact between the connector shells and shield against electromagnetic interference.

In accordance with still another aspect of the present invention, each of the connector shells houses a dielectric insert supporting at least one electrical contact therein, and the mating surface of one of the dielectrical inserts is specially configured to collapse under the force generated by the resilient coupling of the connector members to insure positive abutment of the metallic shells.

BRIEF DESCRIPTION OF THE DRAWINGS

The novel and unobvious features of the present invention are set forth in the appended claims. However, the invention together with its attendant advantages will be best understood by reference to the following description taken in connection with the accompanying drawings in which:

DETAILED DESCRIPTION OF THE PREFERRED EMBODIMENT

Figure 1:
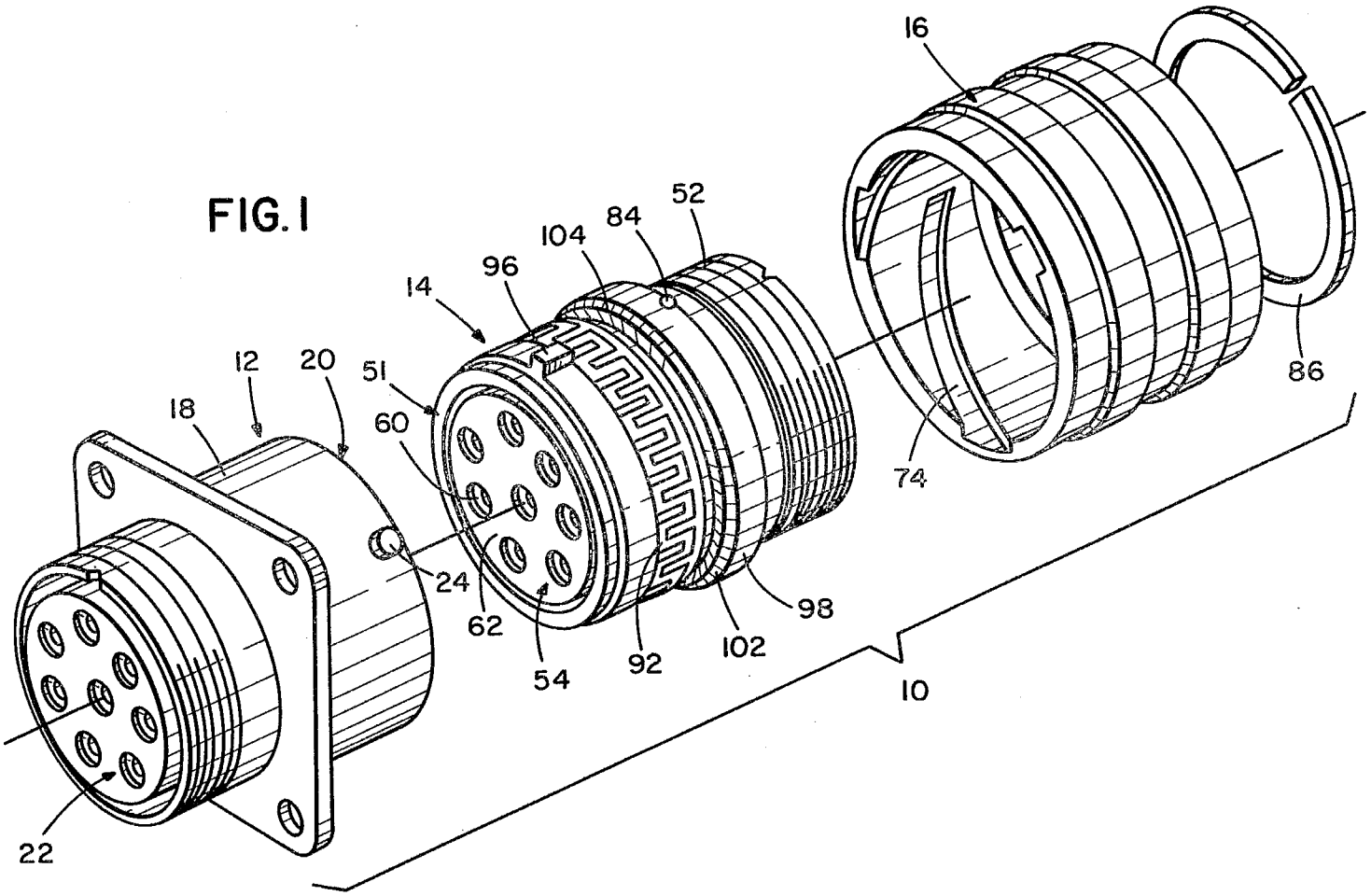
FIG. 1 is an exploded perspective view illustrating the various components of a connector assembly constructed in accordance with the principles of the present invention.
Figure 2:
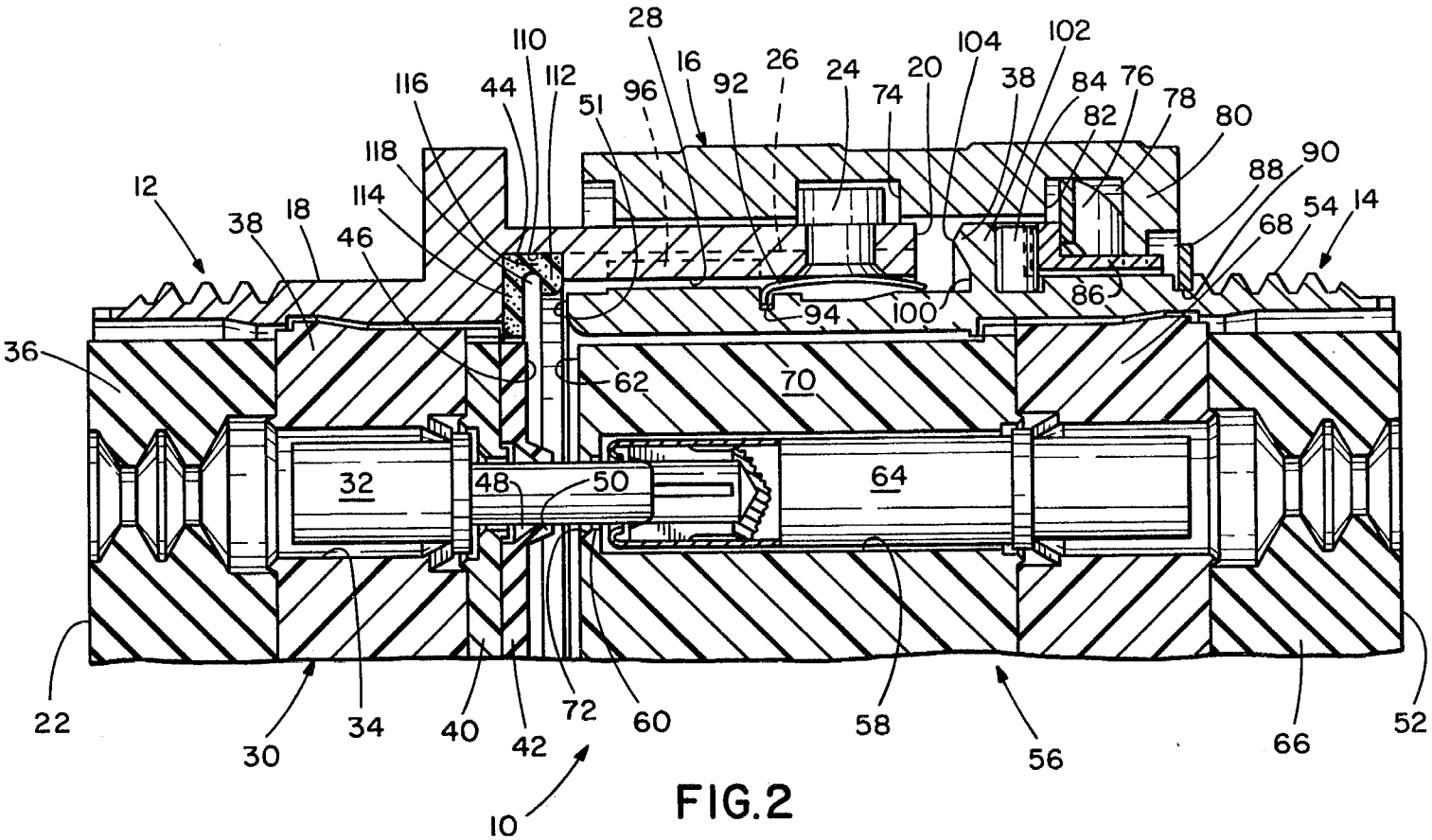
FIG. 2 is a partial sectional view taken along the axial center line of the assembled connector illustrating the relationship of the various structural components when the connector members are in a partially open or unmated condition.

Referring to the drawings, and particularly to FIGS. 1 and 2, an electrical connector assembly, designated generally by reference number 10, is shown and includes a receptacle connector member 12, a plug connector member 14 and a coupling ring 16 for assembling the receptacle connector member and the plug connector member in the electrical connector assembly.

Receptacle connector 12 includes an electrically conductive metallic shell 18 and is conventionally identified as having a forward, mating end 20 and rearward, conductor-receiving end 22. One or more outwardly and radially extending bayonet pins 24 located at an intermediate axial position on shell 18 adjacent forward end 20 and one or more axially extending keyways 26 on the inside surface of the shell adjacent its forward end facilitate the alignment and coupling of the receptacle connector member and the plug connector member.

The forward portion of shell 18 has an axial opening 28 for receiving the plug connector member in mating engagement, and the rearward portion of shell 18 houses a dielectric insert 30 which supports at least one electrical contact 32 in a contact-receiving bore 34. Receptacle insert 30 may comprise, for example, separate inserts such as a rearward grommet 36, a contact retaining disc 38, and an insert disc 40. An interfacial seal member 42 made from a resilient, electrically nonconductive elastomeric material and an annular peripheral seal 44 made from a resilient, electrically conductive elastomeric material seal the inserts in shell 18. Face seal member 42 provides a forward mating surface 46 having one or more contact apertures 48 aligned with each of the electrical contacts and includes an annular sealing boot 50 which extends forwardly of mating surface 46 at each contact aperture 48 to environmentally seal moisture and the like from between contacts in the mated condition.

Plug connector member 14, also conventionally identified as having a forward, mating end 51 and a rearward conductor-receiving end 52, includes an electrically conductive metallic shell 54 and a dielectric insert 56. Insert 56, which is housed in shell 54, includes at least one and typically several contact-receiving bores 58 which terminate in contact apertures 60 at its forward mating surface 62 and in which electrical contacts 64 compatible with contacts 32 of the receptacle connector reside. The number of contacts 64 provided will, of course, correspond to and be positioned for alignment with contacts 32 of the receptacle connector member when the plug member and the receptacle member are mated. Also, it will be understood that insert 56 may also be constructed from a plurality of individual components such as a grommet 66, a contact-retaining disc 68 and an insert disc 70, the insert disc preferably incorporating an annular chamfer 72 about the perimeter of each contact aperture 60.

Coupling ring 16 is rotatably mounted on plug shell 54 and includes at least one helically-directed track 74 on its inside surface which receives bayonet pin 24 and urges the connector members together in the conventional manner upon rotation of the coupling ring. A wave spring 76 is housed within the coupling ring and is retained in the annular recess 78 defined by a rearward annular flange 80 and by an interior shoulder 82 of the ring. Spring 76 develops a biasing force resiliently urging the plug member and the receptacle member together when the connector members are fully mated. A roller 84 and a cooperating detent ring 86 provide a locking mechanism to present inadvertent unmating of the connector assembly. The coupling ring, the wave spring biasing means and the locking mechanism are all maintained in assembled relation on plug shell 54 by a split retainer ring 88 located in an annular groove 90 near the rearward end of the plug shell.

Plug shell 54 supports a circumferential metallic grounding spring 92 at a point rearward of mating end 51, one edge of the spring being bent inwardly to be received and retained in an annular groove 94 on the outer surface of the plug connector shell. Shell 54 further includes one or more axially extending keys 96 adjacent its mating end 51 and an outwardly and radially extending annular flange 98 providing a forwardly-facing annular shoulder 100 intermediate the forward and rearward ends of the plug member.

Figures 3, 4:
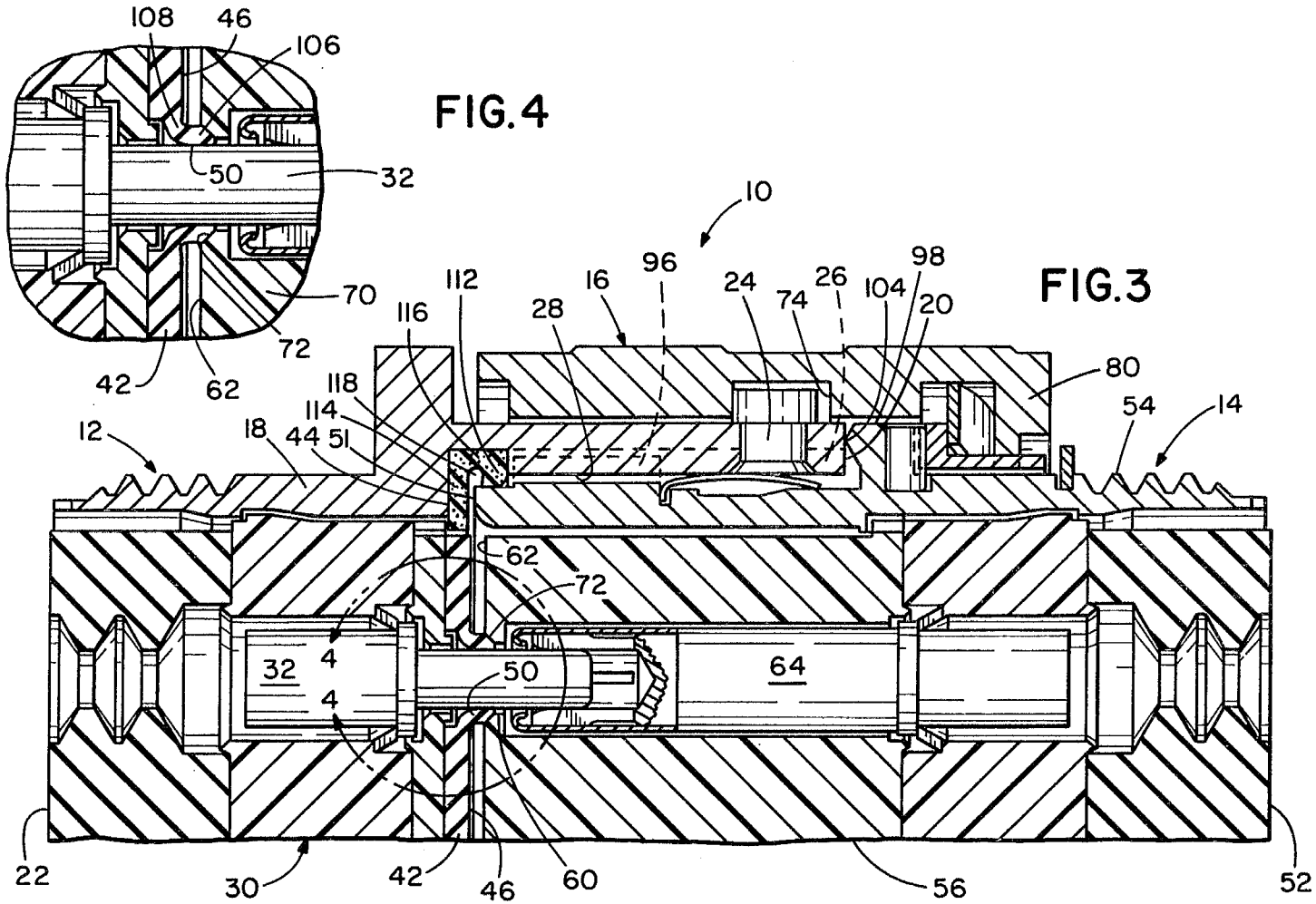
FIG. 3 is a partial sectional view similar to that of FIG. 2, but showing the connector assembly when the connector members are fully mated.
FIG. 4 is an enlarged view of the portion of FIG. 3 encircled by line 4—4 illustrating more clearly the collapsibility of the interfacial mating seal when the connector members are fully mated.

The connector assembly of the present invention is shown in its assembled configuration in FIG. 3. There it can be seen that the connector assembly is mated by aligning keys 96 and keyways 26 and rotating coupling ring 16 to draw or pull receptacle shell 18, via engagement of track 74 and pin 24, toward plug shell 54. As the connector members are drawn toward the fully mated position, wave spring 76 is compressed between detent ring 86 and flange 80, and thereby develops the necessary resilient coupling force acting axially through the assembled components to maintain the connector assembly fully mated. When the connector members are fully mated, electrical contacts 64 and 32 engage, and metallic grounding spring 90 provides an electrical ground connection between plug shell 54 and receptacle shell 18.

In accordance with the present invention, connector assembly 10 includes specifically configured components which combine to enhance the EMI shielding characteristics of the connector assembly. More particularly, shoulder 100 is configured to include or support a forwardly-facing, annular ridge 102 having a sharp circumferential or annular sealing edge 104 positioned to make continuous metal-to-metal engagement or abutment with mating end 20 of receptacle connector member 12. As shown in FIG. 3, when receptacle connector 12 is resiliently mated with plug connector 14 by coupling ring 16, sealing edge 104 positively abuts the annular mating end of receptacle shell 18 to provide continuous metal-to-metal contact between the plug shell and the receptacle shell along their respective peripheries. In order to achieve the necessary continuity of the metal-to-metal abutment, however, sealing edge 104 is positioned to engage the end of receptacle shell 18 radially outwardly of keyways 26. Thus, the sealing edge cooperates with the mating end of the receptacle shell to form an electrically conductive metal seal about the periphery of the connector assembly which shields against electromagnetic interference and acts to compensate for any deviation from a planar and parallel alignment of the mating end 20 of the receptacle shell and shoulder 100 on the plug shell. As an alternative to the annular ridge 102, a conductive elastomeric O-ring may be employed which would also provide the continuous EMI shielding seal about the entire periphery of the interface between the plug and receptacle shells.

The continuity of the metal-to-metal abutment between sealing edge 104 and receptacle mating end 20 is further enhanced by the interfacial face seal member 42 which, as previously noted, includes an annular sealing boot 50 about the periphery of each contact aperture 48. As best shown in FIG. 4, sealing boot 50 includes a seal-forming extremity 106 which engages chamfer 72 on mating surface 62 of the plug insert when the connector assembly is mated. The sealing boot includes a portion 108 of reduced dimension rearward of extremity 106 and thus collapses rearwardly at reduced portion 108 under the resilient coupling force developed by spring 76 when the connector members are fully mated. Since the plug and connector members are spaced at their mating ends with the exception of the seal formed by annular sealing boot 50, the collapse of the sealing boot insures that the necessary EMI shielding abutment exists between mating end 20 of the receptacle shell and the sealing edge of annular ridge 102 on the shoulder of plug shell 54 while maintaining the required environmental protection.

Another aspect of the present invention is the utilization of peripheral seal 44 to provide further protection against EMI. As previously stated, seal 44 is made from a resilient, electrically conductive elastomer. Seal 44 resides in an annular groove 110 in the interior wall of receptacle shell 18 at the rear of opening 28 and thus is in electrical contact with the receptacle shell. The configuration of seal 44 is unique in that it comprises an annular ring having a forward seal-forming lip 112 joined to a base portion 114 by an annular web portion 116 to define an annular recess 118. Accordingly, when the connector members are fully mated, lip 112 engages the plug shell at a point rearward of its mating end 51 while recess 118 is coincident with mating end 51. Thus, seal 44 provides a continuous electrically conductive peripheral seal between the plug shell and the receptacle shell, does not interfere with the mating of keys 96 and keyways 26, and also insures the full and complete metal-to-metal abutment between the plug and receptacle shells. Moreover, the use of an electrically conductive elastomer in peripheral seal 44 not only enhances the connector's EMI shielding capability, alone or in combination with the EMI shielding provided by the abutment of mating end 20 of the receptacle connector with sealing edge 104, but also provides environmental protection.

Accordingly, those skilled in the art will recognize that the novel features of the present invention improve electrical performance by providing improved shielding against EMI yet help to prevent further restriction of the already limited manufacturing tolerances imposed in electrical connectors of the type described herein. In addition, only a few components of the conventional connector assembly need be modified to practice the invention. As a result, electrically conductive sealing of the plug and receptacle shells and the resulting enhanced EMI and EMP shielding can be achieved with less difficulty and expense than would otherwise result. Moreover, existing connector specifications such as size constraints, mechanical strength and rigidity and environmental resistance are not compromised in the implementation of this invention. Finally, the employment of a collapsible interfacial seal such as face seal member 42 greatly reduces the dependency on elastomers of a specific resilience or durometer. Thus the specially configured sealing boot 50 of the interfacial seal and the metal-to-metal abutment between the forward mating end of receptacle shell 18 and sealing edge 104 of the annular shoulder ridge combine to give greater reliability and effectiveness to the connector's EMI shielding characteristics.

Of course, it should be understood that various changes and modifications to the preferred embodiment described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. An electrical connector assembly comprising:

a separable pair of connector members, each of said connector members having an electrically conductive shell;

means for coupling said connector members in mating engagement, said coupling means having means for resiliently urging said connector shells together; and means for providing a continuous electrically conductive seal between said connector shells to shield against electromagnetic interference, including a sharp circumferential sealing edge on one of said connector shells, said circumferential sealing edge facing the other one of said connector shells and engaging an annular surface of said other shell to provide continuous circumferential abutment and electrical contact between said connector shells.

2. An electrical connector assembly in accordance with claim 1 wherein one of said connector shells includes a mating end and the other one of said connector shells includes an opening for receiving the mating end of said one connector shell, and wherein said means for providing a continuous electrically conductive seal between said connector shells further includes a resilient electrically conductive elastomeric seal member housed within said opening in electrical contact with said other connector shell, said seal member engaging said one connector shell peripherally rearward of said mating end and making continuous electrical contact between said one connector shell and said other connector shell.

3. An electrical connector assembly in accordance with claim 2 wherein said seal member comprises an annular ring having a seal-forming lip for peripherally engaging said one connector shell and defines an annular recess disposed coincident with said mating end when said connector members are mated.

4. An electrical connector assembly comprising:

a first connector member having an electrically conductive shell including a forward mating end;

a second connector member having an electrically conductive shell, said second connector shell having an annular shoulder including a forwardly-facing annular ridge having a sharp circumferential sealing edge; and means for coupling said first connector member and said second connector member in mating engagement, said coupling means having means for resiliently urging said sealing edge and the mating end of said first connector shell into continuous circumferential abutment and electrical contact to shield against electromagnetic interference.

5. An electrical connector assembly in accordance with claim 4 wherein said second connector shell includes an outer surface portion and a forward mating end and said first connector shell includes an opening for receiving the forward mating end of said second connector shell therein, and including a peripheral electrically conductive elastomeric seal member housed within said opening in electrical contact with said first connector shell, said seal member engaging the outer surface portion of said second connector shell rearwardly of the forward mating end of said second connector shell and making continuous peripheral electrical contact between said first connector shell and said second connector shell to further shield against electromagnetic interference.

6. An electrical connector assembly in accordance with claim 5 wherein said seal member comprises an annular ring having a seal-forming lip and defines an annular recess disposed coincident with the forward mating end of said second connector shell when said connector members are mated.

7. An electrical connector assembly comprising:

a plug connector member having a metallic plug shell, a dielectric plug insert housed within said plug shell, and at least one electrical contact extending axially in said plug insert, said plug insert having a forward mating surface having at least one contact aperture opening to said electrical contact, and said plug shell having a forward mating end and an annular shoulder rearward of said forward mating end, said shoulder defining a forwardly-facing annular ridge having a sharp circumferential sealing edge;

a receptacle connector member having a metallic receptacle shell, a dielectric receptacle insert housed within said receptacle shell, and at least one complementary electrical contact extending axially in said receptacle insert, said receptacle insert having a forward mating surface having at least one contact aperture opening to said complementary electrical contact, and said receptacle shell having a forward mating end; and means for coupling said plug connector member and said receptacle connector member with said electrical contact and said complementary electrical contact in mating engagement, said coupling means having means for resiliently urging the sharp circumferential sealing edge of said plug shell shoulder and the mating end of said receptacle shell into continuous peripheral abutment and electrical contact to shield against electromagnetic interference and for resiliently urging said plug insert mating surface and said receptacle insert mating surface toward positive abutment.

8. An electrical connector assembly in accordance with claim 7 wherein said plug shell includes at least one key adjacent said plug shell forward mating end and said receptacle shell has an inner surface having at least one keyway adjacent said receptacle shell forward mating end for receiving said key and wherein said annular ridge of said plug shell shoulder engages the forward mating end of said receptacle shell radially outward of said keyway.

9. An electrical connector assembly in accordance with claim 7 wherein said receptacle shell includes an opening for receiving the forward mating end of said plug shell and the forward mating end of said plug shell is axially spaced from said forward mating surface of said receptacle insert when said plug connector member and said receptacle connector member are fully mated, and wherein said receptacle connecter member includes an electrically conductive elastomeric seal member disposed in said opening about the periphery of said receptacle insert mating surface, said seal member engaging the outer surface of said plug shell at a point rearward of the forward mating end of said plug shell.

10. An electrical connector assembly in accordance with claim 9 wherein said seal member comprises an annular ring having a seal-forming lip and defines an annular recess disposed coincident with the forward mating end of said plug shell when said plug connector member and said receptacle connector member are fully mated.

11. An electrical connector assembly in accordance with claim 9 wherein one of said insert mating surfaces includes an annular sealing boot extending forwardly thereof about each contact aperture, said boot being displaced rearwardly upon engaging the other one of said insert mating surfaces as said plug connector member and said receptacle connector member are mated.

12. An electrical connector assembly in accordance with claim 11 wherein said boot includes a seal-forming extremity and a connecting body portion of reduced dimension, said body portion permitting displacement of said sealing extremity rearwardly relative to said one insert mating surface.

13. An electrical connector assembly having improved electromagnetic interference shielding characteristics, said connector assembly comprising:

a plug connector member having a metallic plug shell, a dielectric plug insert housed within said plug shell, and at least one electrical contact extending axially in said plug insert; said plug insert having a forward mating surface having at least one contact aperture opening to said electrical contact, and said plug shell having a forward mating end and an annular shoulder rearward of said forward mating end, said shoulder having a forwardly-facing annular ridge having a sharp circumferential sealing edge;

a receptacle connector member having a metallic receptacle shell, a dielectric receptacle insert housed within said receptacle shell, and at least one complementary electrical contact extending axially in said receptacle insert, said receptacle insert having a forward mating surface having at least one contact aperture opening to said complementary electrical contact, and said receptacle shell having a forward mating end, an opening for receiving the forward mating end of said plug shell and at least one bayonet pin extending radially outward rearward of said forward mating end;

a coupling ring for mating said plug connector member and said receptacle connector member, said coupling ring being rotatably mounted on said plug shell and having at least one bayonet pin-receiving track, said coupling ring also having biasing means for resiliently urging the sealing edge of said annular ridge and the forward mating end of said receptacle shell into continuous circumferential abutment and electrical contact to shield against electromagnetic interference;

said receptacle insert mating surface having a collapsible annular sealing boot extending forwardly thereof about each contact aperture such that said boot will displace sufficiently to insure the abutment of said plug shell and said receptacle shell when said plug connector member and said receptacle connector member are fully mated, the forward mating end of said plug shell being axially spaced from the forward mating surface of said receptacle member when said connector members are fully mated; and a peripheral electrically conductive elastomeric seal member housed within said opening in electrical contact with said receptacle connector shell, said seal member engaging said plug connector shell rearwardly of the forward mating end of said plug connector shell and making continuous electrical contact between said receptacle connector shell and said plug connector shell to further shield against electromagnetic interference.

14. An electrical connector assembly comprising:

a first connector member having an electrically conductive shell including a forward mating end and an outer peripheral surface portion;

a second connector member having an electrically conductive shell defining an opening for receiving the forward mating end of said first connector shell therein;

means for providing a continuous electrically conductive seal between said connector shells to shield against electromagnetic interference, including a resilient electrically conductive elastomeric seal ring housed within said opening in electrical contact with said second connector shell for abutting the forward mating end of said first connector shell, said ring having a seal-forming lip for engaging the outer surface portion of said first connector shell and making continuous peripheral electrical contact between said first and second connector shells and defining an annular recess disposed coincident with said mating end of said first connector shell when said connector members are mated; and means for coupling said first and second connector members in mating engagement with said forward mating end of said first connector shell abutting said seal ring and said seal-forming lip peripherally engaging the outer peripheral portion of said first connector shell.

* * * * *